United States Patent [19]

Morrison et al.

[11] 4,043,551

[45] Aug. 23, 1977

[54] IN-LINE INSERTER

[75] Inventors: Wilbur J. Morrison; Norwood E. Tress, both of Bath, Pa.

[73] Assignee: Bell & Howell Company, Phillipsburg, N.J.

[21] Appl. No.: 594,255

[22] Filed: July 9, 1975

Related U.S. Application Data

[63] Continuation-in-part of Ser. No. 569,989, April 21, 1975.

[51] Int. Cl.[2] ..... B65H 9/06; B65H 9/10

[52] U.S. Cl. ..... 271/243; 271/12; 271/186; 271/270; 271/277

[58] Field of Search ..... 271/243, 275, 277, 10, 271/12, 244, 245–247, 270, 233, 229, 186

[56] References Cited

U.S. PATENT DOCUMENTS

| | | | |
|---|---|---|---|
| 1,618,202 | 2/1927 | Jacobson | 271/229 |
| 1,803,935 | 5/1931 | Federwitz et al. | 271/277 X |
| 2,201,539 | 5/1940 | Kast | 271/243 |
| 2,406,006 | 8/1946 | Eckhard | 271/243 X |
| 2,804,189 | 8/1957 | Huck | 271/243 X |
| 2,887,951 | 5/1959 | Strother et al. | 271/243 X |
| 2,955,822 | 10/1960 | Wicklund | 271/243 |

*Primary Examiner*—Bruce H. Stoner, Jr.
*Attorney, Agent, or Firm*—Griffin, Branigan, Butler

[57] ABSTRACT

A sheet transporting system for transporting sheets from a pull-foot feed mechanism to a stuffing station includes parallel fast and low-speed endless conveyors. The low-speed endless conveyors have pins thereon which extend into the path of sheets transported by the fast endless conveyors. The pins register, and control the speed of, sheets being transported. This transporting mechanism is used in one embodiment for transferring sheets from the pull-foot feeding system into the mouths of clamps on a transporting chain and in another embodiment for transferring sheet to a drum/belt transporting system.

4 Claims, 5 Drawing Figures

IN-LINE INSERTER

This application is a continuation-in-part of U.S. patent application Ser. No. 569,989, filed on Apr. 21, 1975, by Wilbur J. Morrison and Norwood E. Tress for an IN-LINE INSERTER.

BACKGROUND OF THE INVENTION

This invention relates broadly to the art of sheet feeding devices, and more specifically is a continuation-in-part of U.S. patent application Ser. No. 569,989, filed on Apr. 21, 1975 by Wilbur J. Morrison and Norwood E. Tress for an *In-Line Inserter.* This invention also relates to an application of Winston A. Orsinger and Norwood E. Tress, for a *Pull-Foot Sheet Feeding Device.* U.S. patent application Ser. No. 608,970, filed Aug. 29, 1975. Both of these applications have been commonly assigned to the assignee of the instant application. The disclosures in these two applications are hereby incorporated by reference into this application.

The in-line inserter of the Morrison, et al application mentioned above, and the pull-foot sheet feeding device used therein, can be improved in several ways. In this regard, it has been found that it is difficult to obtain access to the suction cup and bottom roller of the insert pull-foot feeding devices in the in-line inserter. Thus, it is an object of this invention to provide structure for making it easier for an operator to gain access to these mechanisms.

Further, it has been found that when the bottom roller is used for detecting doubles and misses, as is described in the Orsinger, et al application mentioned above, that mistake readings are sometimes not obtained even though sheets are not actually fed. That is, the bottom roller and the pull foot might close, on a sheet for example, at which time the bottom roller gives no indication of a mistake; but then when the pull foot reciprocates outwardly, the detected sheet might not be carried with the pull foot. Thus, a mistake reading is not produced even though the sheet is not fed. It is therefore an object of this invention to provide a mistake detector which is more reliable for a pull-foot feeding mechanism.

Similarly, in prior art mistake detectors, detection feelers were often flexible so that they could flex upon making contact with detection points. Such flexing is intended to allow an attached moveable detection roll, or other type follower, to move still further and thereby allow sheets to pass the moveable detection roll. However, a flexible detection feeler is somewhat sloppy in movement and, over a period of time, deforms. Thus, it is an object of this invention to provide a rigid detection feeler but yet allow its moveable detection roll sufficient freedom of movement to handle undue numbers of simultaneously fed sheets.

Another area in which the in-line inserter described in the Morrison, et al application can be improved is in the mechanism for transferring envelopes from the pull-foot envelope feeding device to its chain/clamp mechanism. The problem is that it is difficult to time the insertion of envelopes into the mouths of the clamps as the machine speed is varied immediately before the clamps close. In addition, it is difficult to control the orientations of the envelopes as they are so fed. Therefore, it is an object of this invention to provide a transfer conveying system for properly conveying sheets at controlled speeds and orientations.

SUMMARY

According to principles of this invention, an in-line inserter has separate laterally spaced, ejection roll sets which are on separate axles. In this regard, there are no obstructions between the laterally spaced ejection roll sets. Thus, a free space is left between the ejection roll sets so that an operator can have access to the suction cup of a pull-foot sheet feeding device.

In addition, a mistake detector is positioned slightly downstream of the ejection roll sets, so that it does not provide a reading until sheets are actually being transported by the ejection roll sets. The detector comprises a moveable detection roll which is attached to a rotatable detector lever including a detection feeler. Stationary detection points are positioned on opposite sides of the detection feeler so that the feeler makes contact with one of the opposite points when there is either a "miss" or a "double". The stationary points are mounted on a rotatable point lever. Thus, when there are so many simultaneously fed sheets that the detection feeler must move further than the stationary "doubles" point, the point lever rotates to allow such movement.

The detection system of this invention also includes an adjustable counter for counting the number of mistakes, and for providing an indication of such mistakes only after a predetermined number of mistakes greater than one within a predetermined number of feeds. In one embodiment, the mistakes must be consecutive and four mistakes are required for an indication.

According to further principles of this invention, a transporting mechanism for transporting envelopes from an envelope pull-foot feeding device to a stuffing station includes a transition conveyor having both fast and low-speed parallel endless conveyors. The low speed conveyor has pins thereon against which the fast conveyor drives and holds transported envelopes. The pins, thus, control the orientations and speeds at which the envelopes are fed. Such a system is used in one embodiment in combination with a chain/clamp conveyor to guide the envelopes into the mouths of the clamps. In another embodiment, it is used in connection with a drum/belt conveyor.

BRIEF DESCRIPTION OF THE DRAWINGS

The foregoing and other objects, features and advantages of the invention will be apparent from the following more particular description of the preferred embodiment of the invention, as illustrated in the accompanying drawings, in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
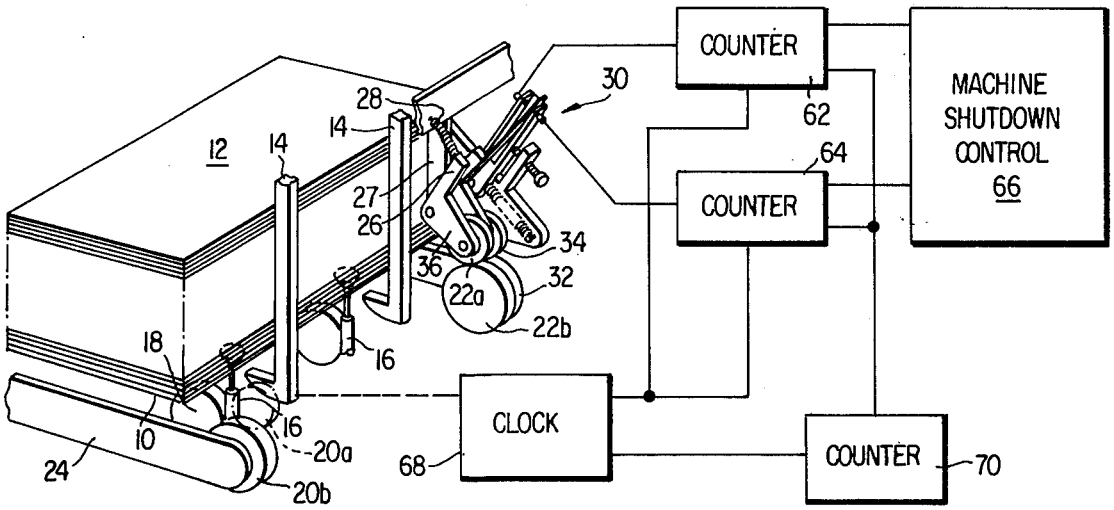
FIG. 1 is an isometric, partially schematic, drawing of a pull-foot insert feeding device for an in-line inserter employing principles of this invention.
Figure 2:
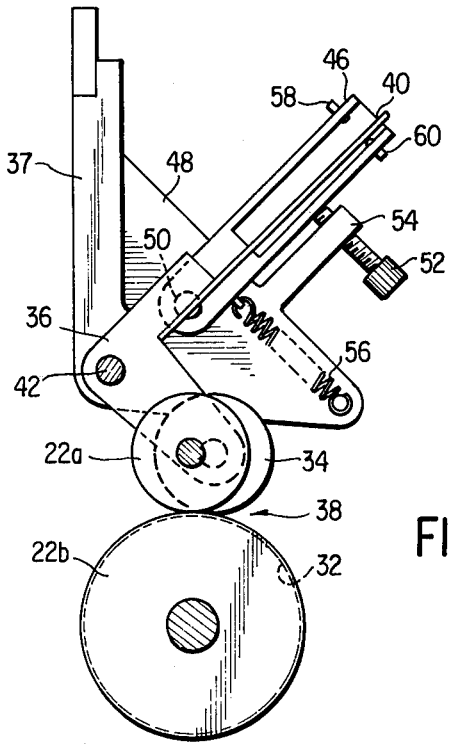
FIG. 2 is a section taken of a portion of the FIG. 1 device depicting a mistake detector.

Referring now to FIGS. 1 and 2, a pull-foot insert feeding mechanism for use with an in-line inserter of the Morrison application, Ser. No. 569,989, filed Apr. 21, 1975, is depicted. In this system, bottom-most inserts 10 in a hopper held stack 12 are withdrawn, one at a time by pull-foot feeding devices 14. In operation, a bottom-most insert 10 is bent away from the hopper held stack 12 by a reciprocating suction cup 16. The pull-foot feeding devices 14 are then cammed to positions in which their "feet" are between the bottom-most insert 10 and the hopper-held stack 12. Bottom rollers 18 are then cammed upwardly to pinch the bottom-most insert between the heel of the pull-foot feeding devices 14 and the bottom rollers 18. The pull-foot feeding devices 14 are then cammed outwardly, away from the hopper-held stack 12, to the right in FIG. 1, pulling the bottom-most insert 10 with it until the bottom-most insert is finally gripped by driven sets of ejection rolls 20*a, b* and 22*a, b*. The ejection rolls 20*a, b* and 22*a, b* feed the inserts to additional transporting mechanisms which will be described below. It might be noted that the ejection rolls 20*a, b* and 22*a, b* may be one-way clutched so that their speed can be increased to follow that of an insert as it is driven faster by additional transporting mechanisms.

With reference to the sets of ejection rolls 20*a, b* and 22*a, b* each set includes upper and lower ejection rolls 20*a* and 22*a* and lower ejection rolls 20*b* and 22*b*. The lower ejection rolls 20*b* and 22*b* are mounted on a stationary frame member 24. However, the upper ejection rolls 20*a* and 22*a* are mounted on ejection roll levers 26 (not shown for upper ejection roll 20*a* for the sake of simplicity). The ejection roll levers 26 are pivotally mounted on stationary frame members 27 and are biased by springs 28 to urge the upper ejection rolls 20*a* and 22*a* toward the lower ejection rolls 20*b* and 22*b* to thereby hold sheets between the upper and lower rolls, but to also allow the upper and lower rolls to part so that an undue number of simultaneously fed sheets can pass between the rolls.

Mounted adjacent to one of the sets of ejection rolls (set 22 in FIG. 1) is a mistake, or double/miss, detector 30. The double/miss detector comprises a lower, stationary, metallic detection roll 32 which is concentric with, and approximately equal in size to, the lower ejection roll 22*b*. The upper detection roll 34 is mounted on a detection lever 36 (FIG. 2) which is pivotally mounted to the frame 37. The upper ejection roll 22*a* is shown in FIG. 2, however, the ejection roll lever 26 on which the upper-ejection roll 22*a* is mounted is not shown in FIG. 2 for the sake of clarity. It can be seen in FIG. 2 that the upper detection roll 34 forms a nip 38 with the lower detection roll 32, which is slightly downstream of the nip formed between the upper and lower ejection rolls 22*a* and 22*b*.

The detection lever 36 includes a rigid detection feeler 40 which moves with the detection lever 36. The detection lever 36 is mounted at a pivot 42 to a portion of the stationary frame 37. A point arm 46 is also pivotally attached to a recessed portion 48 of the stationary frame 37 at a pivot 50. The point arm 46 is held in a stationary position against the tip of an adjusting screw 52, which is screwed into a portion 54 of the frame 37, by a contracting spring 56 which is mounted between the frame 37 and the point arm 46.

The point arm 46 has a "double" electrical contact 58 and a "miss" electrical contact 60.

With reference to FIG. 1, the double and miss electrical contacts 58 and 60 are respectively attached to counters 62 and 64 which store counts up to predetermined amounts and then eject signals to a machine shutdown control 66. The counters 62 and 64 accept signals received from the double and miss electrical contacts 58 and 60 at times selected by a clock 68. The clock 68 is in turn, driven by linkage with the pull-foot feed devices 14 to provide a clock pulse for each reciprocation of the pull-foot feeding devices 14. In another embodiment, not shown, a reset detector is provided for resetting the counters 62 and 64 in response to each proper feed. Thus, only consecutive mistakes can activate the machine shut-down control 66 in this embodiment.

In operation, the ejection rolls 20*a* and *b* and 22*a* and *b*, grip an insert that is fed by the pull-foot feeding devices 14 and the bottom rollers 18. The ejection roll sets 20*a, b* and 22*a, b* positively transport these inserts to the nip of the lower and upper detection rolls 32 and 34. Once an insert sheet is between the detection rolls 32 and 34, the clock 68 is energized by linkage with the pull-foot feeding devices 14 to provide pulses to the counters 62 and 64. If the sheet is of the right thickness, the detection feeler 40 is not touching either of the double or miss electrical contacts 58 and 60, and no signal reaches the counters 62 and 64. However, if there is either a double or a missed insert, the detection feeler 40 will touch respectively the double or miss electrical contact 58 or 60 to thereby complete an electrical circuit to a respective counter and a signal will respectively be fed to that counter. In this event, however, the pull-foot feeding device continues to feed inserts. If the next time the clock 68 provides a pulse to the same counter there is again a similar mistake, a signal will again be sent to that counter. The counters 62 and 64 are adjustable to count to a desired number of counts before ejecting signals to the machine shutdown control 66. Assuming that the "miss" counter 64 is set for three misses, when there have been three misses, the counter 64 sends a signal to the machine shutdown control 66 and the overall pull-foot insert feeding mechanism is shutdown. An operator, at this point, checks out the system to find out what the problem is.

A counter 70 resets the double and miss counters 62 and 64 every predetermined number of feeds of sheets by the pull-foot feeding devices 14 as measured by the clock 68.

It should be recognized that the arrangement of the ejection rolls 20*a* and 20*b* and 22*a* and 22*b* allow easy access by an operator to the suction cup 16 as well as to the bottom rollers 18 and the feet of the pull-foot feeding devices 14.

Further, it will be appreciated by those skilled in the art that by positioning the nip 38 of the lower and upper detection rolls 32 and 34 slightly downstream of the upper and lower ejection rolls 22*a* and 22*b*, only those sheets which are or are not, actually fed by the pull-foot mechanism can produce indications of "doubles" or "misses."

Finally, allowing the point arm 46 to pivot about pivot 50, allows the detection feeler 40 to be rigid and therefore more accurate. In this regard, when the rigid detection feeler 40 contacts the double electrical contact 58, but yet must move further to allow an undue number of sheets to pass between the lower and upper detection rollers 32 and 34, the pivot arm 46 rotates to allow such further movement.

Figure 3:
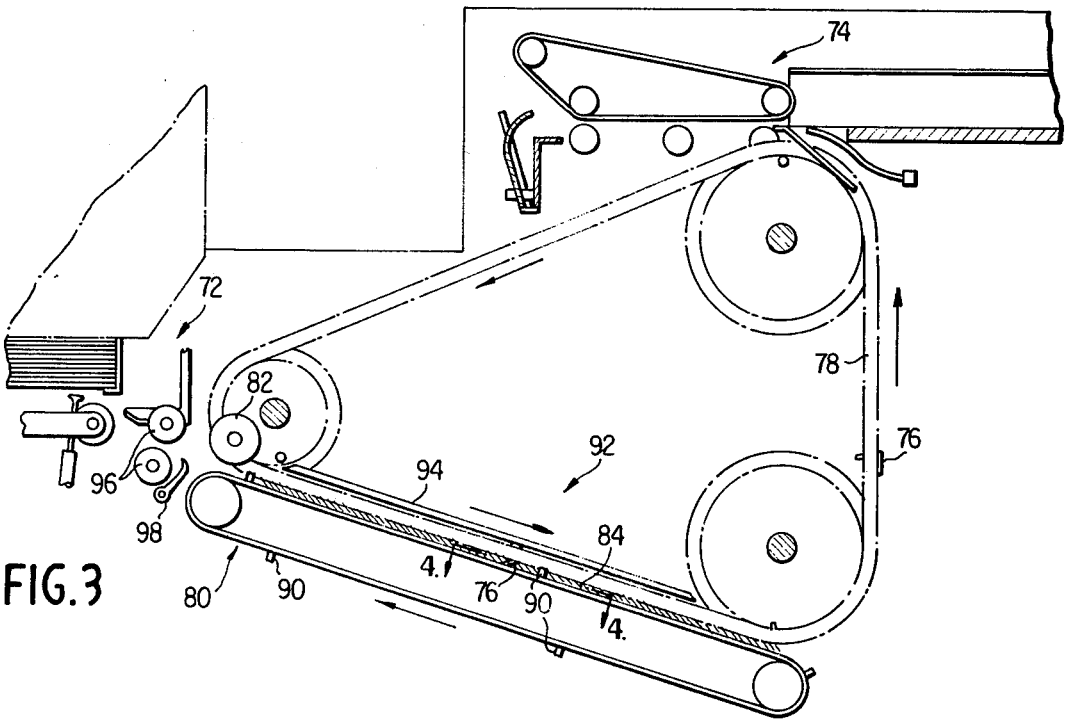
FIG. 3 is a sectional view of a portion of another embodiment in-line inserter for transporting envelopes from a pull-foot feeding device to a stuffing station.
Figure 4:
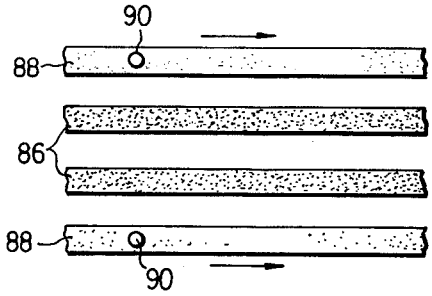
FIG. 4 is a sectional view taken on line 4—4 of FIG. 3.

Turning now to the envelope feeding system of FIGS. 3 and 4, the overall purpose of this system is to feed envelopes received from a pull-foot feeding mechanism 72 to a stuffing station 74. Broadly, this is done by gripping the envelopes with clamps 76 mounted on an endless chain 78, and driving the endless chain. This broad arrangement is described in detail in the Morrison, et at application mentioned above.

This invention relates to a transition conveyor for transferring envelopes from the pull-foot feed mechanism 72 to the clamps 76 of the chain 78. In this respect, it is difficult to time the feeding of envelopes so that they fit properly into the jaws of the clamps 76 at the time that the clamps close. The transition conveyor comprises an endless conveyor system 80, an entrance roll 82, and a brush 84. The endless conveyor system 80 comprises two high-speed endless belts 86 (FIG. 4) that are positioned betwen low-speed registration belts 88. All of these belts travel in approximately coextensive parallel paths. The high-speed endless belts 86 have rougher surfaces than the low-speed registration belts such that the high-speed endless belts have more influence on driving envelopes that are placed on these belts. In one embodiment, the high-speed endless belts 86 are raised slightly higher than the low-speed registration belts, to insure their greater influence of driving.

The low-speed registration felts, however, have registration pins 90 thereon that are arranged in sets of two. These pins extend into the path of sheets driven by the high-speed endless belts.

The brush 84, contacts the upper sides of the envelopes on the endless conveyor system 80 to urge the envelopes toward the high-speed endless belts 86.

The clamps 76 on the endless chain 78 and the pins 90 on the low-speed registration belts 88, travel at the same speed and are in coincidence with each other so that sheets driven against a set of pins 90 are also in a clamp 76 at a station 92. At this station, the clamps are held open by a cam 94.

In operation, envelopes are ejected one at a time from the pull-foot feed mechanism 72 by ejection rolls 96. The flaps of these envelopes are opened by a reciprocating envelope-flap opener 98. Each envelope is picked up by the high-speed endless belts 86 and the entrance roll 82, but thereafter it continues to be fed by the high-speed endless belts 86 and the brushes 84. The high-speed endless belts 86 drive the envelope against a pair of registration pins 90, and thereafter, the high-speed endless belts 86 slip, to hold the envelopes in registration against the pins. Since these pins are synchronized with, and coincident with, open clamps 76 at the station 92, the leading edge of the envelope is inserted into an open clamp 76 where is remains until the clamp and the envelope pass the cam 94, at which time the clamp closes. The clamp then carries the envelope to the stuffing station 74.

It will be appreciated by those skilled in the art that this transition conveying system allows continuous operation of the envelope feeding system while providing accurate registration of envelopes and controlled placing of the envelopes in conveying clamps.

Figure 5:
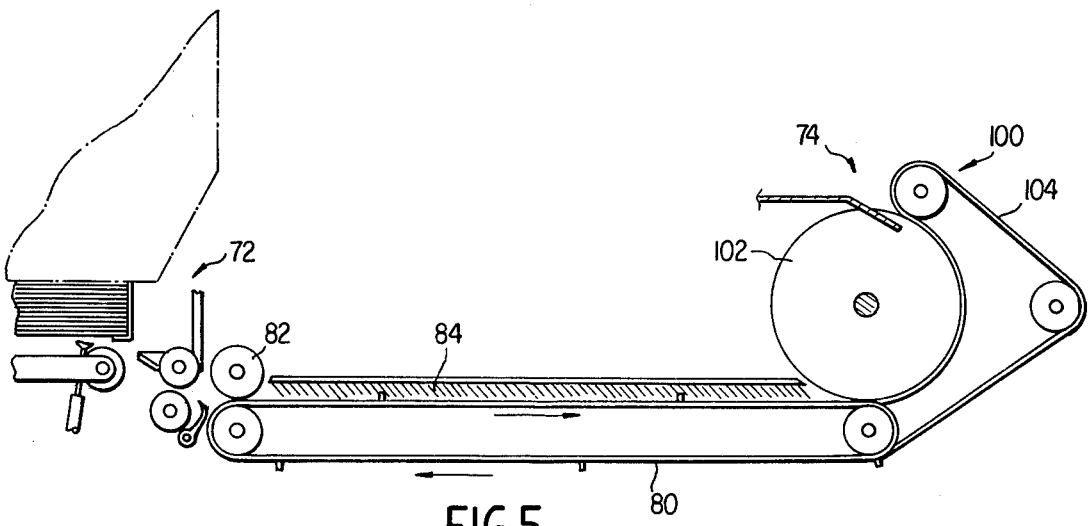
FIG. 5 is a sectional view of an alternate embodiment of a transporting system for transporting envelopes from a pull-foot sheet feeding mechanism to stuffing station of an in-line inserter.

FIG. 5 depicts an embodiment of this invention wherein an endless conveyor system 80 identical to the endless conveyor system 80 of FIGS. 3 and 4, is used to convey envelopes from the pull-foot feed mechanism 72 to a drum/belt feed mechanism 100. In this case, the drum/belt feed mechanism 100 replaces the endless chain 78 and clamps 76 of the FIG. 3 embodiment. However, operation of the endless conveyor system 80 is the same as described with reference to FIG. 4. When envelopes leave the endless conveyor system 80 of FIG. 5, they are clamped between a drum 102 and a belt 104 which are driven to move the envelopes to the stuffing station 74.

Again, it will be understood by those skilled in the art that the conveyor system 80 provides continuous feeding of envelopes, while insuring registration and controlled speed of the envelopes.

Although this invention has been described in connection with several embodiments, it will be understood by those skilled in the art that additional changes and modifications could be made within the scope of the invention.

I claim:

1. In a sheet feeding system comprising:

sheet supply means for supplying sheets one at a time; and sheet transporting means for receiving said supplied sheets, transporting said sheets along an initial sheet path while simultaneously orienting said supplied sheets to have a predetermined attitude relative to said sheet transporting means, and thereafter transporting said supply sheets along a curved sheet path while maintaining said predetermined attitude relative to said sheet transporting means, said sheet transporting means comprising a curved endless conveyor having clamps mounted thereon for gripping and transporting said sheets in said curved path while maintaining said sheets in said predetermined attitude, said clamps including a means for opening said clamps at appropriate times to receive and to release said sheets and closing said clamps at appropriate times to grip said sheets;

the improvement wherein said sheet transporting means further includes a fast-speed endless conveyor, a low-speed endless conveyor, and an elongated brush positioned adjacent to said curved endless conveyor, said fast- and low-speed endless conveyors being adjacent to said initial sheet path and being positioned on the same side of said initial sheet-path following parallel, laterally spaced, paths, and said elongated brush being positioned on the opposite side of said initial sheet path from said fast- and low-speed conveyors for continuously urging sheets traveling along said initial sheet path against said fast speed conveyor, said fast- and low-speed conveyors and said brush receiving said supplied sheets and transporting them to said clamps, said low speed endless conveyor having pins thereon against which the fast-speed endless conveyor drives and, in cooperation with said brush, holds said supplied sheets to thereby orient said supplied sheets to have said predetermined attitude relative to said sheet transporting means, said fast- and low-speed endless conveyors and said brush being located relative to said clamps of said curved endless conveyor such that said sheets are held against said pins by said fast-speed endless conveyor and said brush as they enter and are clamped by said clamps of said curved endless conveyor to maintain said predetermined attitude.

2. In a sheet feeding system as in claim 1, wherein said curved endless conveyor transports said sheets in a curved path of approximately 180° to thereby invert said sheets and direct them in approximately the opposite direction from which the sheets travel in said initial sheet path.

3. In a sheet-feeding system comprising:

sheet supply means for supplying sheets one at a time; and sheet transporting means for receiving said supplied sheets, transporting said sheets along an initial sheet path while simultaneously orienting said supplied sheets to have a predetermined attitude relative to said sheet transporting means, and thereafter transporting said supplied sheets along a curved sheet path while maintaining said predetermined attitude relative to said sheet transpoting means, said sheet transporting means comprising a curved conveyor including a cylindrical drum and an endless belt pressing against said drum for gripping said sheets therebetween and transporting said sheets in a curved path while maintaining said sheets in said predetermined attitude;

the improvement wherein said sheet transporting means further includes a fast-speed endless conveyor, a low-speed endless conveyor, and an elongated brush positioned upstream of said curved conveyor adjacent to said initial sheet path, said fast- and low-speed conveyors being positioned on the same side of said initial sheet path and following parallel, laterally-spaced, paths, and said elongated brush being positioned on the opposite side of said initial sheet path from said fast- and low-speed conveyors for urging sheets travelling along said initial sheet path continuously against said fast-speed conveyor, said fast- and low-speed conveyors and said brush receiving said supplied sheets and transporting them to said drum and said endless pressure belt, said low speed endless conveyor having pins thereon against which the fast-speed endless conveyor drives and, in cooperation with said brush, holds the supplied sheets to thereby orient the supplied sheets to have said predetermined attitude relative to said sheet transporting means, said fast- and low-speed endless conveyors and said brush being located relative to said drum and said endless pressure belt such that said sheets are held against said pins by said fast-speed endless conveyor and said brush as they enter a nip formed between said drum and said endles pressure belt in said predetermined orientation.

4. In a sheet feeding system as in claim 3, wherein said curved conveyor transports said sheets in a curved path of approximately 180° to thereby invert said sheets and direct them in approximately the opposite direction from which the sheets travel in said initial sheet path.

* * * * *

UNITED STATES PATENT AND TRADEMARK OFFICE

CERTIFICATE OF CORRECTION

PATENT NO. : 4,043,551

DATED : August 23, 1977

INVENTOR(S) : Wilbur J. Morrison; Norwood E. Tress

It is certified that error appears in the above-identified patent and that said Letters Patent are hereby corrected as shown below:

Column 2, line 67, after "to", insert --a--.

Column 4, line 28, change "58 and 60" to --58 or 60--; and, at line 29, change "62 and 64" to --62 or 64--.

Column 5, line 10, correct the spelling of "et al."; line 20, correct the spelling of "between"; line 29, change "felts" to --belts--; and, line 55, change "is" to --it--.

Column 7, line 14, correct the spelling of "transporting" and,

Column 8, line 20, correct the spelling of "endless".

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*